US005112220A

United States Patent [19]

Wimberger et al.

[11] Patent Number: 5,112,220

[45] Date of Patent: May 12, 1992

[54] AIR FLOTATION DRYER WITH BUILT-IN AFTERBURNER

[75] Inventors: Richard J. Wimberger, DePere; Richard A. Carman, Green Bay, both of Wis.

[73] Assignee: W.R. Grace & Co.-Conn., Lexington, Mass.

[21] Appl. No.: 203,137

[22] Filed: Jun. 7, 1988

[51] Int. Cl.[5] ..... F26B 13/00

[52] U.S. Cl. ..... 432/8; 432/59; 432/72; 34/23; 34/32; 34/34; 34/36; 34/155; 34/156

[58] Field of Search ..... 34/23, 30, 32, 34, 36, 34/37, 155, 156; 432/72, 59, 8

[56] References Cited

U.S. PATENT DOCUMENTS

| | | | |
|---|---|---|---|
| 2,706,344 | 4/1955 | Vaughan | 34/17 X |
| 2,743,529 | 5/1956 | Hayes . | |
| 2,750,680 | 6/1956 | Houdry et al. . | |
| 2,795,054 | 6/1957 | Bowen . | |
| 3,561,928 | 2/1971 | Weber . | |
| 3,757,427 | 9/1973 | Wilkinson | 34/32 |
| 3,800,429 | 4/1974 | Lindl . | |
| 3,874,091 | 4/1975 | Fukumoto . | |
| 3,875,678 | 4/1975 | Vits . | |
| 3,882,612 | 5/1975 | Try et al. | 34/27 |
| 3,909,953 | 10/1975 | Hemsath et al. . | |
| 3,936,951 | 2/1976 | Hanueise et al. | 34/219 X |
| 4,116,620 | 9/1978 | Stibbe | 34/155 X |
| 4,206,553 | 6/1980 | Ellison et al. . | |
| 4,504,220 | 3/1985 | Sunakawa et al. | 432/72 |

*Primary Examiner*—Albert J. Makay
*Assistant Examiner*—John Sollecito
*Attorney, Agent, or Firm*—Hugh D. Jaeger

[57] ABSTRACT

A compact efficient air flotation dryer with a built-in afterburner for combustion of solvent-laden air within a dryer-enclosed combustion chamber. An internal exhaust fan propels internal solvent-laden air across a burner where it combusts, causing a heat rise. Heated, combusted air is routed to a recirculating supply air fan which provides for pressurized heated air for air bars for drying a web. Heated air in excess of that required to dry the web is vented externally and helps to maintain desired solvent concentration levels. Variable parameters such as fan speed, burner temperatures, air box pressures, exhaust air rate, solvent concentration, supply air flow, supply air temperature and damper vane position are monitored, and the components are actuated to effect a high level of clean up efficiency.

7 Claims, 8 Drawing Sheets

AIR FLOTATION DRYER WITH BUILT-IN AFTERBURNER

CROSS REFERENCES TO CO-PENDING APPLICATIONS

This patent application relates to a "Control System for Air Flotation Dryer With Built-in Afterburner", Ser. No. 07/203,129, by Jun. 7, 1988, and assigned to the same assignee as this patent.

BACKGROUND OF THE INVENTION

1. Field of the Invention

The present invention relates to a web dryer such as for use in drying of a web in the printing industry, and more particularly, pertains to a highly compact air flotation dryer which uses internal solvent-laden air as a combustion medium to generate high internal drying temperatures for use in drying a web and thereby minimizing solvent-laden air exhausted into the atmosphere.

2. Description of the Prior Art

Prior art web dryers were notorious in being operationally inefficient in web drying, consuming large amounts of physical floor space, and lacking in sophisticated computerized monitoring and control of the web dryer. Prior art web dryers attempted to reduce to a negligible amount the solvent concentration exhausted into the atmosphere through a variety of methods such as by using incinerators to combust the solvents in the dryer air, then attempting to recover the heat from the burned or combusted solvents by heat exchangers. Other methods include removing solvents from the air with the use of catalytic converters.

Two representative prior art patents are "Method and Apparatus for Purifying Exhaust Air of a Dryer Apparatus", U.S. Pat. No. 3,875,678 and "Method of Curing Strip Coating", U.S. Pat. No. 4,206,553. Both of these patents disclose prior art dryers as discussed above.

The present invention overcomes the disadvantages of the prior art by providing coordinated control of built-in exhaust fan speed, damper vanes, burner pressures and box pressures to maintain optimum combustion chamber temperature, supply air temperature, supply air flow, solvent concentration (LFL) and exhaust air rate.

SUMMARY OF THE INVENTION

The general purpose of the present invention is to provide a compact and efficient air flotation dryer with a built-in afterburner where solvent-laden evaporate is combusted. This subsequently creates a heat source for use in drying a web, and also combusting a great majority of harmful, noxious or pollutant vapors before such air is released into the atmosphere. Solvent-laden evaporate is propelled by an exhaust fan across a burner, which uses various premixes of a fuel medium and air, for combustion by the burner. The heat from the combusted solvents flows by forced air through an optional monolith catalyst, into a heat distribution chamber to be ducted to the interior of the enclosure, and to be propelled by a recirculation supply fan through additional ducting, and subsequently to air bars. The heated air may also alternatively be routed to the air bars through a sparger and a static mixer in series with the recirculating supply fan. Excess combusted air may be routed externally through an exhaust duct.

According to one embodiment of the present invention, there is provided an insulated enclosure with four sides, a top and a bottom with access doors disposed along one side with a system of interconnected fans, ducts, air bars, a burner, cladding and other elements contained therein. A variable speed exhaust fan is ported to the interior of the enclosure and connects to a combustion compartment by a steel duct. The combustion compartment includes a gas supply duct, a burner with air flow mixing plates and profile plates disposed horizontally about the burner and combustion chamber. The upper end of the combustion chamber connects a transition chamber, which may include an optional monolith catalyst and a heat distribution chamber. The heat distribution chamber includes an exhaust duct with a plurality of ceramic alloy damper vanes therein, perpendicular to a side wall for accommodation of an external chimney flue. The heat distribution chamber also includes a hot air return duct attached thereto, including a plurality of ceramic alloy damper vanes venting to the dryer enclosure. In the alternative, a sparger and static mixer tube connects the hot air return duct to a recirculating air supply fan. The circulating return air fan is connected by a circulating air plenum directly to a lower supply duct and through a vertical duct to an upper supply duct. The upper and lower supply ducts connect to horizontally oriented, vertically moveable supply headers which connect to a plurality of opposing air bar members. The air bar members secure between opposing upper and lower frame pairs.

One significant aspect and feature of the present invention is a compact air flotation dryer with an enclosed, integral afterburner. The air flotation dryer and the built-in afterburner includes ceramic alloy damper vanes to withstand a high internal temperature.

Another significant aspect and feature of the present invention is the use of a variable speed exhaust fan to maintain the solvent concentration at 50% or less of the lower flammability limit.

Still another significant aspect and feature of the present invention is the use of a sparger assembly and a static mixer to mix heated air with spent recirculated air prior to entering a recirculation fan.

Still another significant aspect and feature of the present invention is the coordinated control of built-in exhaust fan speed, damper vanes, burner firing rate, and box pressures to maintain optimum chamber temperature, supply air temperature, solvent concentration and exhaust air rate. Hot combustion products are utilized as the sole or primary dryer heat source.

Having thus described the embodiments of the present invention, it is the principal object hereof to provide an air flotation dryer with an integral built-in afterburner for the combustion of vaporous flammable solvents within the air flotation dryer.

One object of the present invention is sophisticated coordinated monitoring and control capabilities of air flow through the system of the air flotation dryer.

Another object of the present invention is high temperature operation with the hot combustion chamber being self-contained within the dryer enclosure.

Additional objects of the present invention include overall fuel efficiency of air flotation dryer with the built-in afterburner. A quieting chamber is provided to prevent belching of solvent laden air. Elevated recirculation air humidity levels add enhanced product quality to the paper webs.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
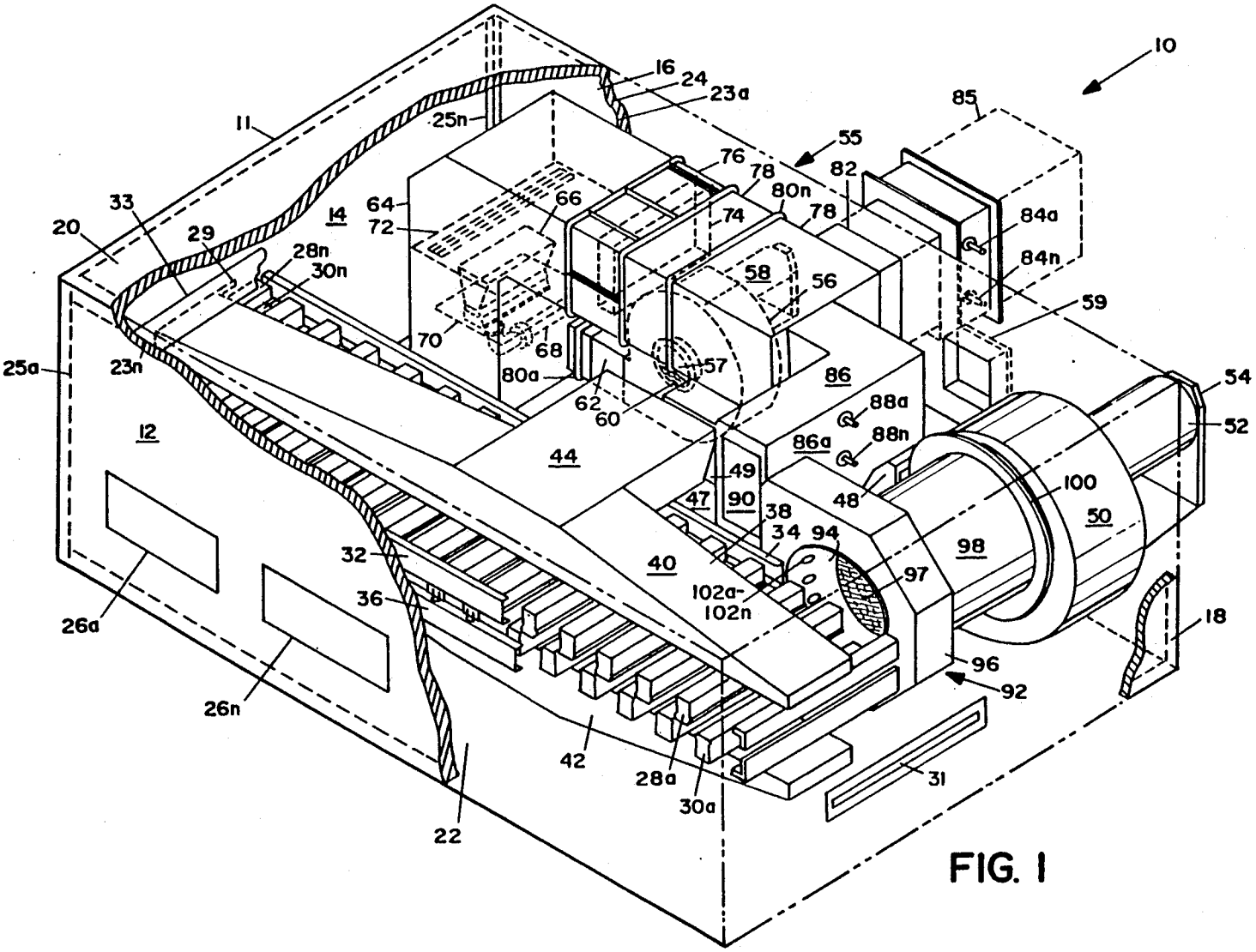
FIG. 1 illustrates a perspective view in cutaway cross section of an air flotation dryer with a built-in afterburner.

FIG. 1 illustrates a perspective view in cutaway cross section of an air flotation dryer with a built-in afterburner, hereinafter referred to and designated the dryer 10. A dryer enclosure 11 includes side members 12, 14, 16, and 18, a top 20 and a bottom 22, each of which includes insulation cladding 24 between a plurality of steel cladding sheets 23*a*–23*n* and the inner surface of each of the members. The side members 12–18, the top 20 and the bottom 22 secure over and about a plurality of frame members 25*a*–25*n*. A plurality of access doors 26*a*–26*n* are disposed along side member 12 for access to a plurality of opposing aligned upper air bars 28*a*–28*n* and lower air bars 30*a*–30*n* mounted in upper frame pairs 32–34 and lower frame pairs 36–38, respectively. A web passes between the pluralities of upper and lower air bars 28*a*–28*n* and 30*a*–30*n*, respectively, for drying of the passing web and enters and exits the dryer enclosure 11 at slots 29 and 31 on the enclosure sides. A quieting chamber 33 secures over the entry slot 29. An upper air supply header 40 and a lower air supply header 42 provides heated drying air to the respective upper and lower air bars 28*a*–28*n* and 30*a*–30*n*. The upper and lower air supply headers 40 and 42 are hydraulically positioned with respect to the upper and lower air bars 28*a*–28*n* and 30*a*–30*n* in enclosures 132 and 134 illustrated in FIG. 4.

A lower supply duct 46, illustrated in FIGS. 2 and 3, aligns below an upper supply duct 44, and provide pressurized heated drying air to the upper and lower air supply headers 40 and 42. A circulating air plenum 48 of FIG. 3 connects with a vertical duct 49 and a horizontal duct 47, between the upper supply duct 44 and the lower supply duct 46 and delivers recirculated air from a recirculating air supply fan 50 powered by a motor 52 and a drive mechanism 54. Electrically driven dampers 45 and 43 are located in ducts 49 and 47. A makeup air damper 59 located on side member 16 opens to maintain a desired dryer negative pressure if the dryer negative pressure exceeds a preset maximum value. The dryer afterburner 55 includes, among other members, a variable speed exhaust fan 56, powered by exhaust fan motor 58 and having an inlet screen 60. The variable speed exhaust fan 56 draws solvent-laden or otherwise flammable gaseous enclosure air through the fan inlet 57 and propels the air through a metal duct 62 to a ceramic insulated combustion compartment 64. The air combusts in or near the flame of a burner 66 where the remaining solvent can be rapidly oxidized down stream of the flame of the burner 66. A gas supply duct 68 supplies gas to the burner 66. The burner 66 is a raw gas type burner with partial premix of combustion air. The partial premix stabilizes the flame when the exhaust air stream becomes low in oxygen, below 16% oxygen, by way of example and for purposes of illustration only. The gas supply delivered through the gas supply duct can also include a full air and methane premix. Methane, air, and residual heavy weight hydrocarbons $C_{12}$–$C_{23}$ from the dryer enclosure are combusted in the burner 66. A perforated air flow straightener plate positions about the lower portion of the burner 66 to distribute the output of the variable speed exhaust fan evenly across the burner 66. A profile plate 72 positions horizontally across the ceramic insulated combustion compartment 64 and about the burner 66 to regulate or modify air flow differential between the area above and the area below the burner. Down stream combustion can be further augmented by an optional high space velocity monolith catalyst 74 as desired. The catalyst 74 secures in a transition chamber 76 between the ceramic insulated combustion compartment 64 and a heat distribution chamber 78. The catalyst can be a bead or monolithic form or bead-monolithic form, each of which can include a precious metal, a base metal, a precious metal and a base metal combination, or any other form of catalyst as required either in a bead form, monolithic form, or a combination of bead form and monolithic form. A plurality of expansion joints 80*a*–80*n* as illustrated position between various members of the afterburner, such as between the output of the variable speed exhaust fan 56 and the ceramic insulated combustion compartment 64, between the combustion compartment 64 and the transition chamber 76, between the transition chamber 76 and the heat distribution chamber 78, and in the mid-portion of the heat distribution chamber 78.

Heated air from the ceramic insulated combustion compartment 64 is forced by the variable speed exhaust fan 56 into the heat distribution chamber 78, and can be channeled into either two directions. First, heated air from the heat distribution chamber 78 can pass to the exterior of the dryer enclosure 11, through an exhaust duct 82 protruding perpendicular from side member 16 and through servo controlled hot exhaust damper vanes 84*a*–84*n* contained in the flow path of the exhaust duct 82 and to atmosphere through a flue 85. Second, the other portion of the heated air can pass from the heat distribution chamber 78 into a hot air return duct 86, through servo controlled hot air return damper vanes 88*a*–88*n*, and into the interior of the dryer enclosure 11 through the end orifice 90 of the hot air return duct 86. An optional sparger assembly 92, including a sparger ring 94, a sparger housing 96, and an inlet screen 97, is illustrated between the hot air return duct 86 and the recirculating fan inlet 100 of the recirculating air supply fan 50. An optional static mixer tube 98 is shown disposed between the optional sparger assembly 92 and the recirculating fan inlet 100. Without utilization of the sparger assembly, the heated air from the interior of the dryer enclosure 11 is drawn partially by the variable speed exhaust fan 56 and partially by the recirculating air supply fan 50. The recirculating air supply fan 50 supplies heated pressurized air through the circulating air plenum 48, the vertical duct 49, and upper and lower supply ducts 44 and 46 to the upper and lower air bars 28*a*–28*n* and 30*a*–30*n* accordingly.

Control of dedicated air flow is accomplished by the use of the optional sparger assembly 92. Of course, the end orifice 90 would then be located on the side wall 86*a* of the hot air return duct 86 and aligned with the sparger housing 96. Hot air from the hot air return duct 86 then flows through the hot air return duct 86, the servo controlled hot air return damper vanes 88*a*–88*n*, through the end orifice 90, through the sparger housing 96, through a plurality of holes 102*a*–102*n* in the sparger ring 94, into the recirculating air supply fan 50, and through the appropriate supply ducts. This supplies heated pressurized air to the upper and lower air bars 28*a*–28*n* and 30*a*–30*n*. Approximately 75% of the system air flow passes through the recirculating air supply fan 50 to the upper and lower air bars 28*a*–28*n* and 30*a*–30*n*. As previously described in detail, a portion of the heated air flow can be exhausted overboard through the exhaust duct 82 or through the hot return duct 86 to maintain internal temperatures in a desired range.

Figure 2:
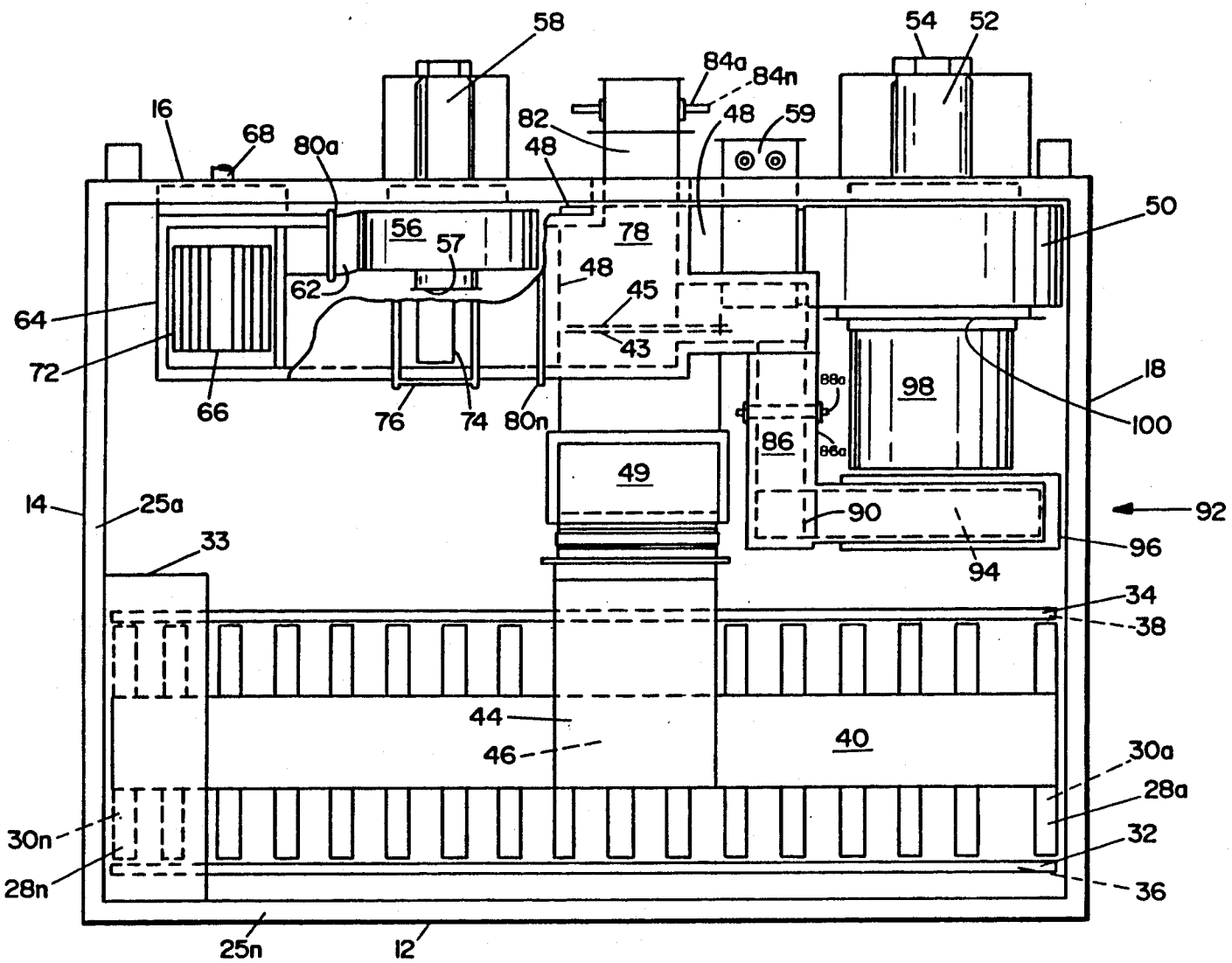
FIG. 2 illustrates a top view in cutaway cross section of an air flotation dryer with a built-in afterburner.

FIG. 2 illustrates a top view in cutaway cross section of the dryer 10 where all numerals correspond to those elements previously described. Shown in particular detail is the vertical duct 49 connected between the circulating air plenum 48 and the upper supply duct 44.

Figure 3:
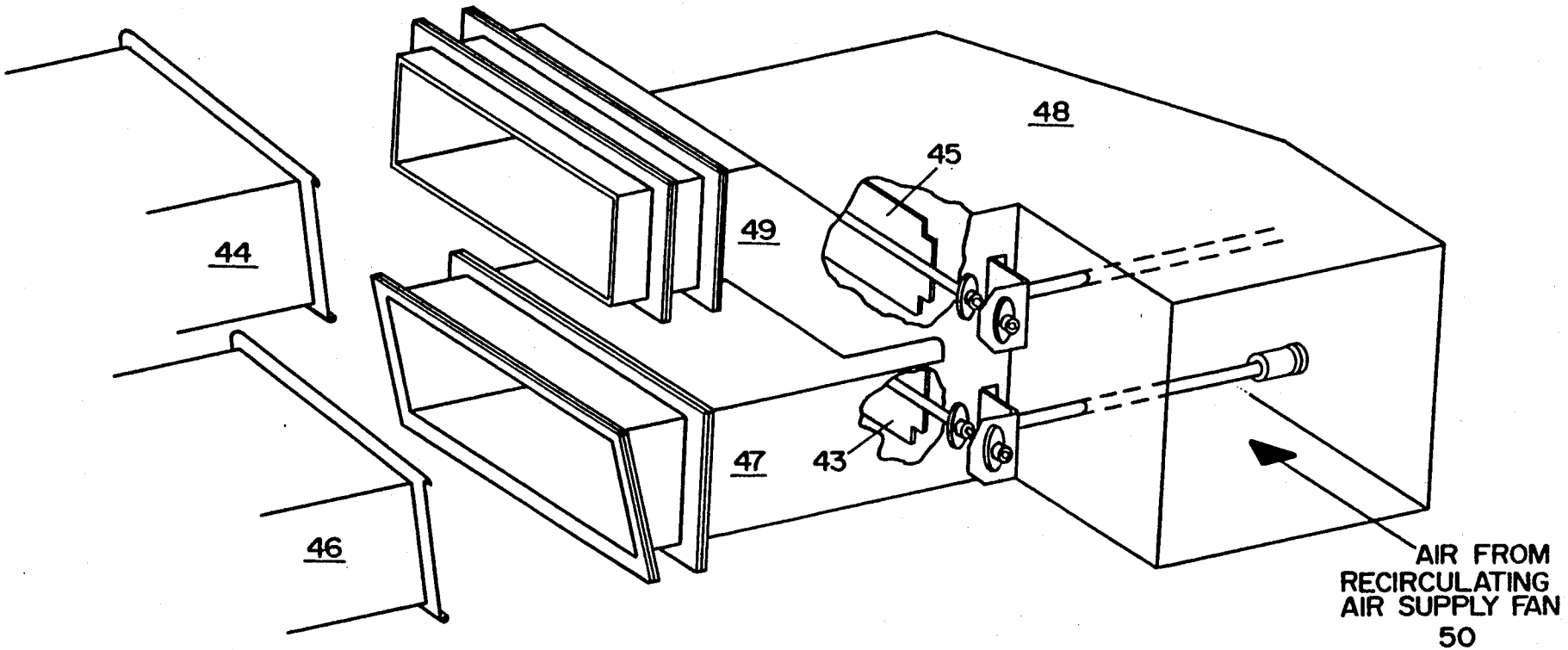
FIG. 3 illustrates a perspective view of the circulating air plenum.

FIG. 3 is a perspective view of the circulating air plenum 48 illustrating the vertical and horizontal ducts 49 and 47, and motor driven dampers 45 and 43 interposed between the circulating air plenum 48 and the ducts 49 and 47. The upper and lower supply ducts are also illustrated for connection to ducts 49 and 47. Placement of the circulating air plenum 48 can be referenced on FIG. 2 wherein the plenum is located partially beneath the heat distribution chamber 78 and to the left of the recirculating air supply fan 50 and hot air return duct 86.

Figure 4:
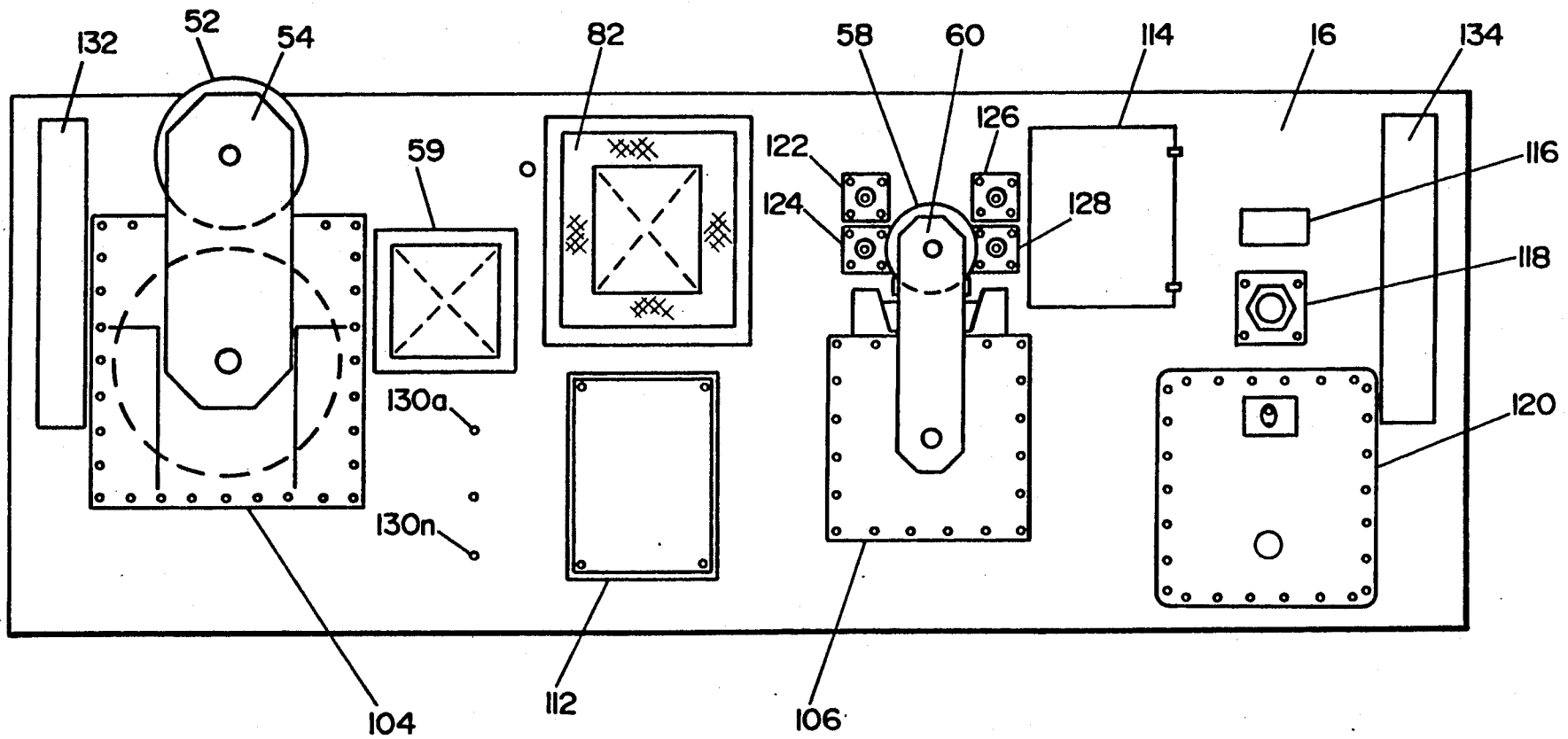
FIG. 4 illustrates a rear view of an air flotation dryer with a built-in afterburner.

FIG. 4 illustrates a rear view of the dryer 10 where all numerals correspond to those elements previously described. Motors 52 and 58 and the respective drive mechanisms secure to mounting plates 104 and 106 on the side member 16. Other elements mounted on the side member 16 include the makeup air damper door 59, the exhaust duct 82, an access door 112, a catalyst access door 114, an ultraviolet scanner 116, a burner sight port 118, a burner access door 120, high temperature limit switches 122 and 124, thermocouples 126 and 128, and a plurality of inside air sample ports 130*a*–130*n*. Enclosures 132 and 134 enclose assemblies for raising or lowering the upper and lower air supply headers 40 and 42.

Figure 5:
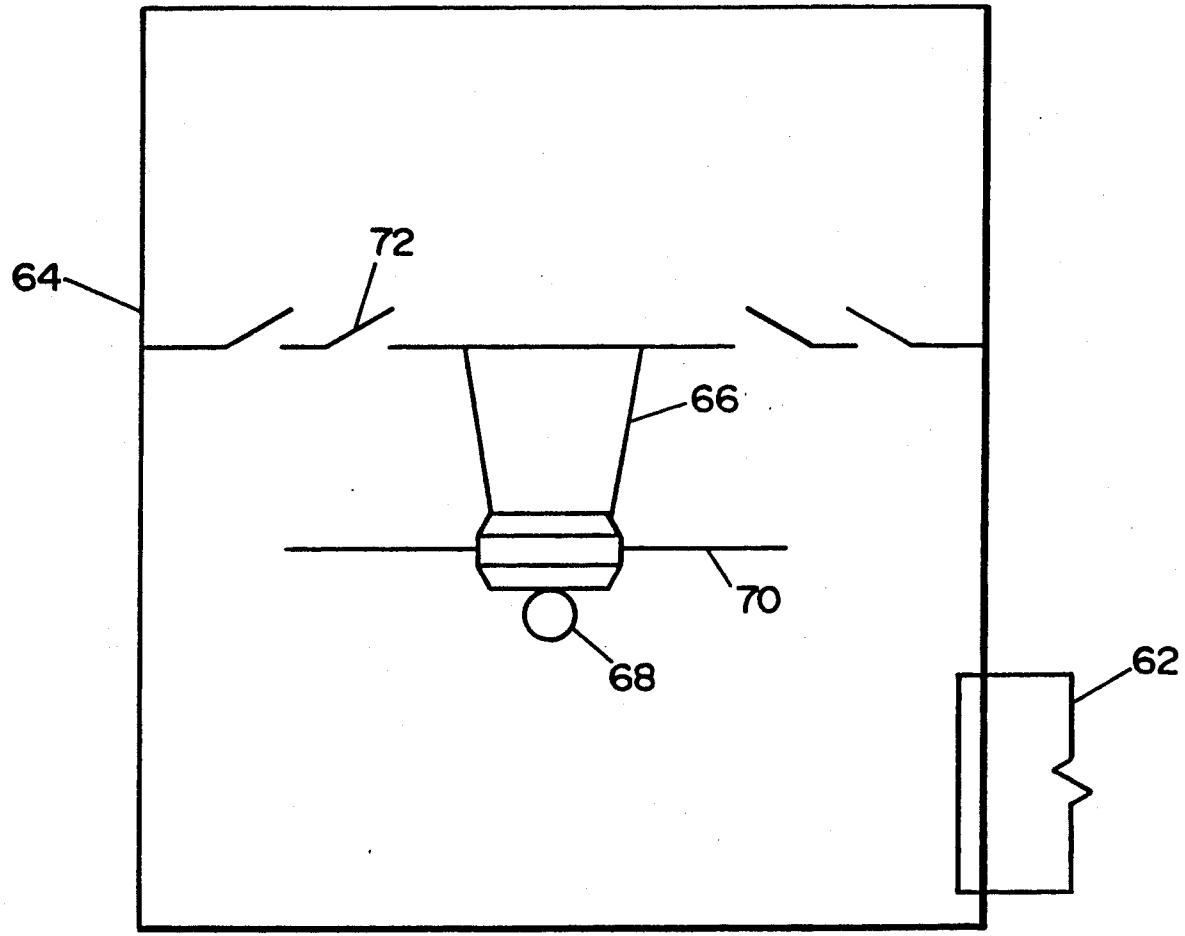
FIG. 5 illustrates a side view of the combustion compartment.

FIG. 5 illustrates a side view of the ceramic insulated combustion compartment 64 where all numerals correspond to those elements previously described. Plate 70 is a perforated air straightener plate for channeling incoming air from the metal duct 62 vertically through or adjacent to the burner 66. The profile plate 72 is adjustable to control air passage rates through and by the burner 66, and to also control combustion rates in the ceramic insulated combustion compartment 64.

MODE OF OPERATION

FIGS. 1–5 illustrate the mode of operation of the dryer 10. A typical graphic arts dryer may have a "web" heat load of 500,000 net Btu/hr. This is the heat required to "dry" the ink on the paper web. Typically, the supply air temperature is about 350° F. ±150° F., and the final web temperature is about 300° F. ±100° F. In the present invention, spent, solvent-laden air is exhausted through a variable speed exhaust fan 56, through a metal duct 62 and past a burner 66 where the exhaust stream is heated to about 1600° F. Most of the solvent in the exhaust stream is combusted in or near the burner flame, and the remaining solvent is oxidized rapidly downstream of the burner flame. Downstream combustion may be augmented by an optional high space velocity monolith catalyst 74 if desired. The ceramic insulation in the ceramic insulated combustion compartment 64 is about 2 inches thick.

The burner 66 is a raw gas type burner with partial premix of combustion air. The partial premix stabilizes the flame when the exhaust air stream becomes low in oxygen such as below 16% oxygen.

One factor of operation is high temperature combustion of 600° F. to 2200° F. with the hot ceramic insulated combustion compartment 64 being completely contained within the dryer enclosure 11. Due to high temperature of the exhaust through the heat distribution chamber 78, the exhaust rate is lowered by the hot exhaust damper vanes 84*a*–84*n*. The solvent concentration is controlled to 50% or less of lower flammability limit (LFL) indirectly by the variable speed exhaust fan 56 which controls combustion compartment pressure. An air gap is left between the exterior of the ceramic insulated combustion compartment 64 and the internal cladding sheets 23*a*–23*n* of the dryer walls, top, side, and bottom members 12–22 which minimizes the need for insulation in the combustion chamber.

The speed of the variable speed exhaust fan 56 is controlled to maintain a constant combustion chamber pressure. After startup, the overall exhaust rate is reduced by closing the ceramic alloy hot exhaust damper vanes 84*a*–84*n* until an LFL of 50% is reached or until a preset minimum is reached or until a specific box negative pressure is reached. Solvent concentration is monitored with the lower flammable limit (LFL) monitor. The LFL monitor overrides the normal control of hot exhaust damper vanes 84*a*–84*n* to maintain the LFL of 50% or less. The firing rate of the burner 66 is controlled by the temperature set point in the ceramic insulated combustion compartment 64. The supply air "web drying air" temperature is controlled by servo controlled hot air return damper vanes 88*a*–88*n* which allow hot combustion products to flow directly back to the recirculating fan inlet 100. An optional sparger assembly 92 and/or static mixer tube 98 can be used to enhance the mixing of the hot return air from the hot air return duct 86 with the supply air.

Coordinated control of built-in exhaust fan speed, damper vanes, makeup air, burner temperatures, and box pressures is utilized to maintain optimum combustion chamber temperature, supply air temperature, supply air flow, solvent concentration (LFL), and exhaust air rate. High clean-up efficiencies of 99% or higher can be achieved with the synergistic system.

Figure 6:
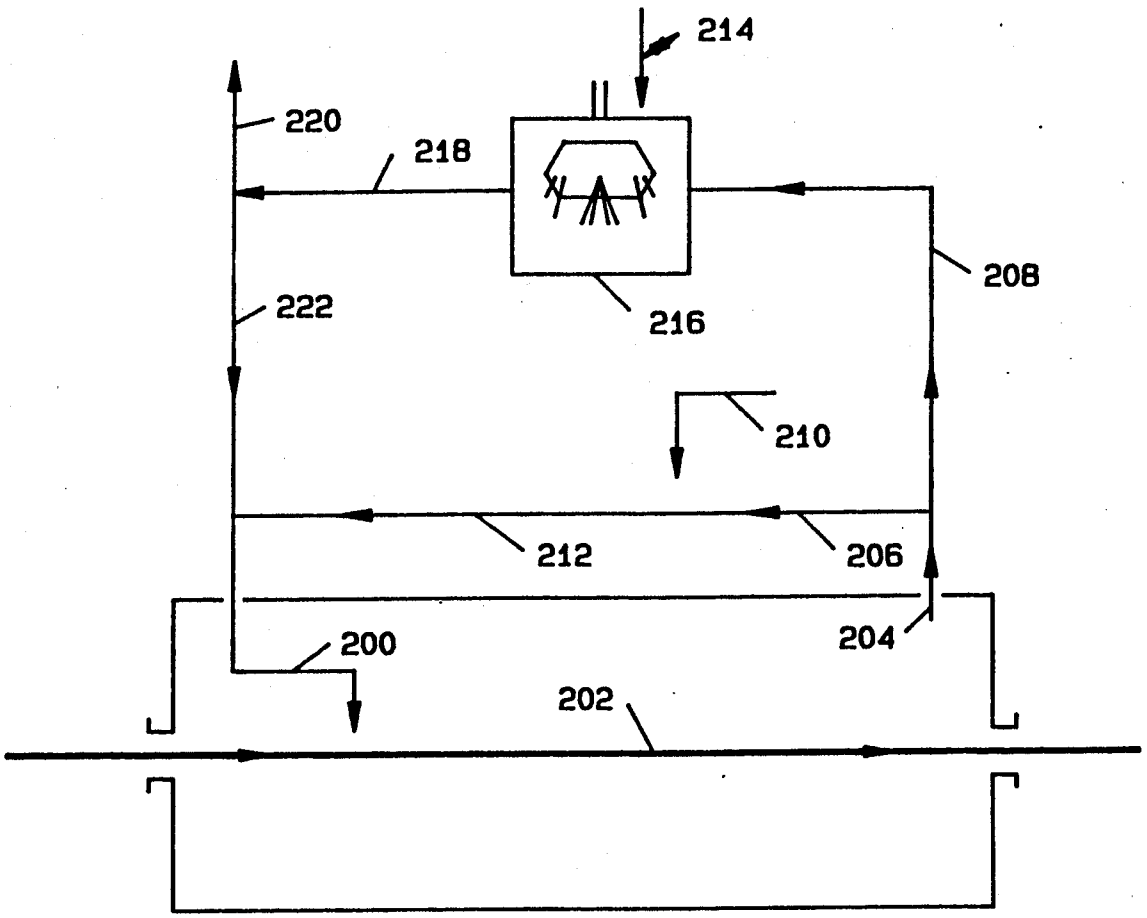
FIG. 6 illustrates an air flow schematic diagram of the air flotation dryer with built-in afterburner.

FIG. 6 illustrates an air flow schematic diagram of the air flotation dryer with built-in afterburner. The figure also includes the abbreviations for the symbols in the figure.

Figure 7:
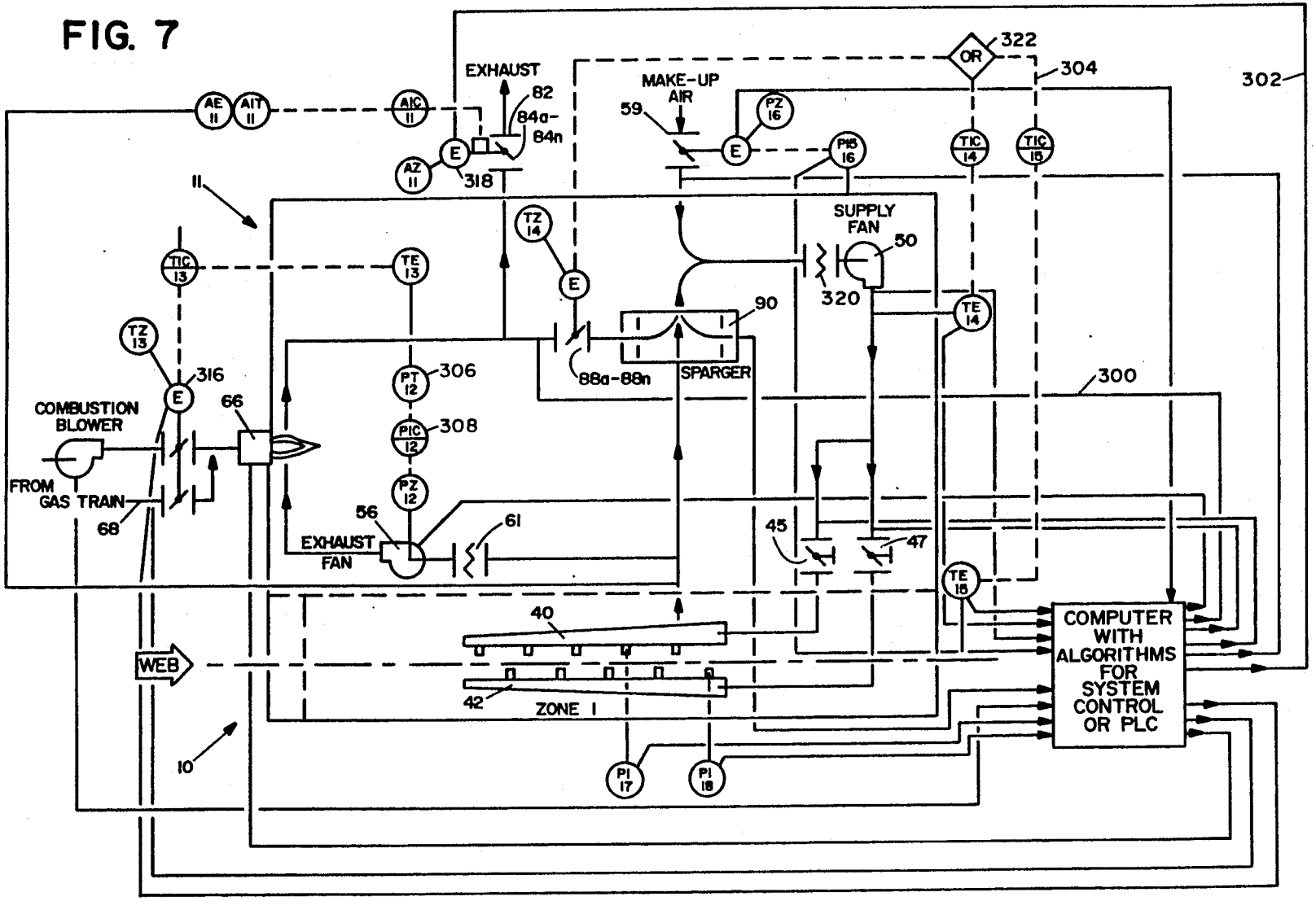
FIG. 7 illustrates an electromechanical control diagram of the air flotation dryer with a built-in afterburner; and, FIG. 8 illustrates the legends for FIG. 7.
Figure 8:
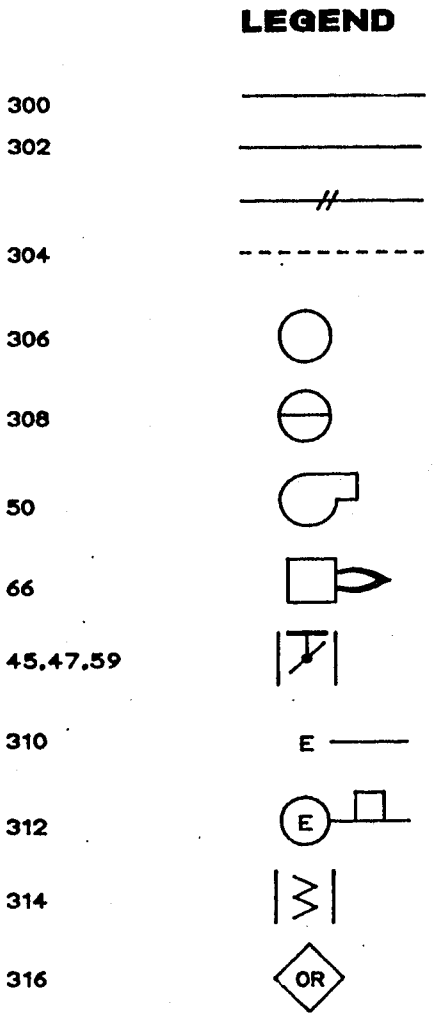

FIG. 7 illustrates an electromechanical control diagram for the dryer 10. All numerals correspond to those elements previously described. The structure of FIG. 6 can be controlled such as by a microprocessor based computer or a programmable logic controller (PLC). The legends are illustrated in FIG. 8. The instrument identification letters are set forth below in Table 1.

TABLE 1

| Instrument Identification Letters | |
|---|---|
| AE | Analysis Element |
| AIC | Analysis Indicating Controller |
| AIT | Analysis Indicating Transmitter |
| AZ | Analysis Final Control |
| PI | Pressure Indicator |
| PIC | Pressure Indicating Controller |
| PIS | Pressure Indicating Switch |
| PT | Pressure Transmitter |
| PZ | Pressure Final Control |
| TE | Temperature Element |
| TIC | Temperature Indicating Controller |
| TZ | Temperature Final Control |
| X | |

The electromechanical control diagram of FIG. 6 is the subject matter of a corresponding patent application entitled "Control System for Air Flotation Dryer with Built-in Afterburner", Ser. No. 07/203,129, filed on Jun. 7, 1988, and assigned to the same assignee as this patent.

Various modifications can be made to the present invention with departing from the apparent scope hereof. Components can be located external to the housing and ducted accordingly for connection thereto. One example would be the exhaust fan. The damper vanes or vanes can be one or more as so determined. Ceramic may or may not be used for insulation of ducts and vanes.

We claim:

1. Air flotation dryer with a built-in afterburner having opposing air bars for drying a web of material comprising:

a. an enclosure including web slots at opposing ends of said enclosure;

b. opposing air supply headers in said enclosure and positioned about a web moving through said enclosure for supplying heated air to a plurality of air bars connected to said air supply headers;

c. a variable speed exhaust fan in said enclosure;

d. combustion chamber means connected to said exhaust fan;

e. burner means in said combustion chamber means, and gas and combustion sources connected to said burner means;

f. heat distribution chamber connected to said combustion chamber means;

g. servo controlled exhaust damper connected to said heat distribution chamber for venting of gases to outside said enclosure;

h. hot air return duct connected to said heat distribution chamber;

i. recirculating air supply means connected to said hot air return duct;

j. servo controlled hot air return damper connected between said hot air return duct and said recirculating air supply;

k. air plenum and duct means connected between said recirculation air supply means and said opposing air supply headers, whereby supply air to said headers is controlled by said hot air return damper thereby providing for hot combustion products to flow directly back to said recirculating air supply means; and, l. a servo controlled makeup air damper positioned in a wall of said enclosure.

2. Air flotation dryer with a built-in afterburner having opposing air bars for drying a web of material comprising:

a. an enclosure including web slots at opposing ends of said enclosure;

b. opposing air supply headers in said enclosure and positioned about a web moving through said enclosure for supplying heated air to a plurality of air bars connected to said air supply headers;

c. a variable speed exhaust fan in said enclosure;

d. combustion chamber means connected to said exhaust fan;

e. burner means in said combustion chamber means, and gas and combustion sources connected to said burner means;

f. heat distribution chamber connected to said combustion chamber means;

g. servo controlled exhaust damper connected to said heat distribution chamber for venting of gases to outside said enclosure;

h. hot air return duct connected to said heat distribution chamber;

i. recirculating air supply means connected to said hot air return duct;

j. servo controlled hot air return damper connected between said hot air return duct and said recirculating air supply;

k. air plenum and duct means connected between said recirculation air supply means and said opposing air supply headers, whereby supply air to said headers is controlled by said hot air return damper thereby providing for hot combustion products to flow directly back to said recirculating air supply means; and, l. a sparger means connected between said hot air return duct and said recirculating air supply means.

3. Air flotation dryer with a built-in afterburner having opposing air bars for drying a web of material containing flammable solvent comprising:

a. an enclosure including web slots at opposing ends of said enclosure;

b. opposing air supply headers in said enclosure and positioned about a web moving through said enclosure for supplying heated air to a plurality of air bars connected to said air supply headers to vaporize flammable solvent;

c. a variable speed exhaust fan in said enclosure;

d. combustion chamber means connected to said exhaust fan;

e. burner means in said combustion chamber means, and gas and combustion sources connected to said burner means for oxidizing at least a portion of said vaporized flammable solvent;

f. heat distribution chamber connected to said combustion chamber means for collecting heated air produced by said burner means;

g. servo controlled exhaust damper connected to said heat distribution chamber for venting of gases to outside said enclosure;

h. hot air return duct connected to said heat distribution chamber;

i. recirculating air supply means connected to said hot air return duct;

j. servo controlled hot air return damper connected between said hot air return duct and said recirculating air supply;

k. air plenum and duct means connected between said recirculation air supply means and said opposing air supply headers, the flow of supply air to said headers being controlled by said hot air return damper thereby providing for heated air to flow directly back to said recirculating air supply means, and thereby controlling the temperature of the air in said heaters; and, l. said exhaust fan controls air flow from said heat distribution chamber to said exhaust damper and to said hot air return duct.

4. Dryer of claim 3 wherein said heated air flows to said exhaust damper, passes through an exhaust duct, through a servo controlled hot exhaust damper, and to an exhaust flue.

5. Dryer of claim 3 wherein said heated air flows to said hot air return duct, through hot air return damper vanes, and to said hot air return duct.

6. Process of circulating air through an air flotation dryer with an afterburner comprising:

a. supplying heated air from an air supply to opposing air bars for flotation and drying of a web;

b. recirculating spent air back to said air supply with a recirculating fan;

c. adding makeup air to said recirculated air;

d. exhausting spent air with vaporous solvents to a burner area with an exhaust fan;

e. adding combustion air to said burner air and oxidizing said vaporous solvents to produce a heated combustion exhaust;

f. returning a portion of the said combustion exhaust to said supply air with said recirculating fan;

g. exhausting a portion of the combustion exhaust outside of said air flotation dryer; and, h. mixing with a sprager said air supply with said hot return air.

7. Air flotation dryer with a built-in afterburner having opposing air bars for drying a web of material comprising:

a. an enclosure including web slots at opposing ends of said enclosure;

b. opposing air supply headers in said enclosure and positioned about a web moving through said enclosure for supplying heated air to a plurality of air bars connected to said air supply headers;

c. a variable speed exhaust fan in said enclosure;

d. combustion chamber means connected to said exhaust fan;

e. burner means in said combustion chamber means, and gas and combustion sources connected to said burner means;

f. heat distribution chamber connected to said combustion chamber means;

g. servo controlled exhaust damper connected to said heat distribution chamber for venting of gases to outside said enclosure;

h. hot air return duct connected to said heat distribution chamber;

i. recirculating air supply means connected to said hot air return duct;

j. servo controlled hot air return damper connected between said hot air return duct and said recirculating air supply;

k. air plenum and duct means connected between said recirculation air supply means and said opposing air supply headers, whereby supply air to said headers is controlled by said hot air return damper thereby providing for hot combustion products to flow directly back to said recirculating air supply means;

l. said exhaust fan controls air flow to said exhaust damper and to said hot air return duct; and, m. means for monitoring plenum pressure.

* * * * *